US009526273B2

(12) United States Patent
Liu

(10) Patent No.: US 9,526,273 B2
(45) Date of Patent: Dec. 27, 2016

(54) ELECTRONIC CIGARETTE

(71) Applicant: Qiuming Liu, Guangdong (CN)

(72) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 586 days.

(21) Appl. No.: 14/026,675

(22) Filed: Sep. 13, 2013

(65) Prior Publication Data

US 2015/0027460 A1 Jan. 29, 2015

(30) Foreign Application Priority Data

Jul. 24, 2013 (CN) ..... 2013 2 0445499 U

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 320/115
See application file for complete search history.

(56) References Cited

U.S. PATENT DOCUMENTS

2010/0200006 A1* 8/2010 Robinson ..... A24F 47/008 131/194
2011/0036346 A1* 2/2011 Cohen ..... A61M 15/0065 128/200.14
2011/0304282 A1* 12/2011 Li ..... A24F 47/008 315/362
2013/0192617 A1* 8/2013 Thompson ..... A24F 47/008 131/329
2014/0053832 A1* 2/2014 Postma ..... A24F 47/004 128/202.21
2014/0334804 A1* 11/2014 Choi ..... A61M 15/06 392/404

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

The present invention provides an electronic cigarette, and the electronic cigarette comprises an outer sleeve, a battery mounted inside the outer sleeve, and a controlling module configured to control working of the electronic cigarette; the electronic cigarette further comprises a bracket detachably mounted inside the outer sleeve; both the battery and the controlling module are mounted on the bracket. By implementing the electronic cigarette in the present invention, the following advantages can be achieved. By adopting a structure of the bracket by the electronic cigarette, the battery and the controlling module can be detachably mounted inside the outer sleeve, and the operation of replacing the battery and assembly can be achieved easily, which are conducive for automated production.

15 Claims, 11 Drawing Sheets

ELECTRONIC CIGARETTE

CROSS-REFERENCE TO RELATED APPLICATION

This application claims priority of application No. 201320445499.8, filed on Jul. 24, 2013 in the Intellectual Property Office of The Republic of China, which is incorporated by reference herein in its entirety.

FIELD OF THE INVENTION

The present invention relates to the field of consumer electronic products, and more particularly relates to an electronic cigarette.

BACKGROUND OF THE INVENTION

An electronic cigarette is mainly used to quit smoking, or used as a substitute of tobacco. At present, an electronic cigarette on the market generally includes a battery assembly and an atomizer assembly. The battery assembly includes a battery and a controlling module, and the controlling module integrates an air flow sensor, a control circuit and so on. When the electronic cigarette is smoked, the battery assembly controlled by the controlling module supplies electric power to the atomizer assembly, and the atomizer assembly is driven to work to generate smoke.

In the existing electronic cigarette, the battery is usually connected to the controlling module by adopting line-welded connection way so that the battery supplies electric power to the controlling module. But when this connection way is adopted, it is not convenient for loading or unloading the battery and the controlling module, and not conducive for automated production and the replacement of the battery.

SUMMARY OF THE INVENTION

The objective of the present invention is to provide an electronic cigarette which can be easily assembled and disassembled, aiming at the defects of the inconvenience of loading or unloading the battery for the electronic cigarette in the prior art.

The technical solutions of the present invention for solving the technical problems are as follows.

An electronic cigarette is provided, and the electronic cigarette comprises an outer sleeve, a battery mounted inside the outer sleeve, and a controlling module configured to control working of the electronic cigarette; the electronic cigarette further comprises a bracket detachably mounted inside the outer sleeve; both the battery and the controlling module are mounted on the bracket.

Advantageously, the electronic cigarette further comprises a first electrode connecting member and a second electrode connecting member; both the first electrode connecting member and the second electrode connecting member are mounted on an end of the outer sleeve; the battery includes a first electrode and a second electrode, and the first electrode is disposed opposite the second electrode;

the controlling module includes a first electrode terminal electrically connected to the first electrode, a second electrode terminal electrically connected to both the second electrode and the first electrode connecting member, and a third electrode terminal electrically connected to the second electrode connecting member.

Advantageously, the electronic cigarette further comprises a mounting seat; the first electrode terminal, the second electrode terminal and the third electrode terminal are respectively mounted on the mounting seat.

Advantageously, the bracket includes a bracket main body and a battery slot defined on the bracket main body and corresponding to the battery; the battery is detachably mounted inside the battery slot.

Advantageously, the electronic cigarette further comprises a first elastic plate connected to the first electrode and the first electrode terminal; the first elastic plate includes a first fixed part, and a convex first elastic part defined on the first fixed part;

the first fixed part is mounted on the bracket main body, and abuts against the first electrode terminal; and the first elastic part is disposed inside the battery slot and elastically abuts against the first electrode.

Advantageously, the bracket further includes a first elastic plate installed slot being defined on the bracket main body and abutting an end of the first electrode; the first fixed part is mounted inside the first elastic plate installed slot.

Advantageously, the electronic cigarette further comprises a second elastic plate connecting the second electrode and the second electrode terminal;

the second elastic plate includes a second fixed part, and a convex second elastic part and a elastic plate resisting part that are both mounted on the second fixed part; an end of the second electrode terminal, abutting the battery, is defined a convex terminal resisting part;

the second elastic part is disposed inside the battery installed slot, and elastically abuts against the second electrode; the elastic plate resisting part, the terminal resisting part and the first electrode connecting member all abuts against an inner surface of the outer sleeve.

Advantageously, the bracket further includes a second elastic plate installed slot defined on the bracket main body and abutting the second electrode; the second fixed part is mounted inside the second elastic plate installed slot.

Advantageously, the electronic cigarette further comprises a third elastic plate connected to the second electrode connecting member and the third electrode terminal;

the third elastic plate includes a third fixed part electrically connected to the third electrode terminal and a convex third elastic part defined on the third fixed part;

an end of the bracket main body, abutting the second electrode and the third fixed part are connected to each other; the third elastic part elastically abuts against the second electrode connecting member.

Advantageously, the electronic cigarette further comprises a connecting wire; one end of the connecting wire is electrically connected to the third electrode terminal, and the other end of the connecting wire is electrically connected to the third fixed part.

Advantageously, the bracket also includes a fastener being defined on an end of the bracket main body and abutting the second elastic plate installed slot; the third fixed part defines a fastening recess connected to the fastener.

Advantageously, the bracket further includes a fastening recess being defined on an end of the bracket main body and abutting the second elastic plate installed slot; the third fixed part defines a fastener connected to the fastening recess.

Advantageously, the electronic cigarette further comprises an insulating ring defined between the first electrode connecting member and the second electrode connecting member and configured to achieve electrical insulation.

Advantageously, the electronic cigarette further comprises a lamp assembly; the lamp assembly is mounted on an end of the outer sleeve that is aloof from the first electrode connecting member.

Advantageously, a shell of the lamp assembly is made of soft rubber material.

Advantageously, the outer sleeve includes an atomizing sleeve and a battery sleeve detachably connected to the atomizing sleeve; an atomizer assembly of the electronic cigarette is mounted inside the atomizing sleeve; the bracket, the battery, the controlling module are all mounted inside the battery sleeve.

Advantageously, both the battery and the controlling module are detachably mounted on the bracket.

By implementing the electronic cigarette in the present invention, the following advantages can be achieved. By adopting a structure of the bracket by the electronic cigarette, the battery and the controlling module can be detachably mounted inside the outer sleeve, and the operation of replacing the battery and assembly can be achieved easily, which are conducive for automated production. Furthermore, structures that first elastic plate elastically abuts the first electrode, and the second elastic plate elastically abuts the second electrode, are adopted by the electronic cigarette, so that the battery can be fixed on the bracket more firmly and reliably, and the operation of unloading the battery can be achieved easily.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
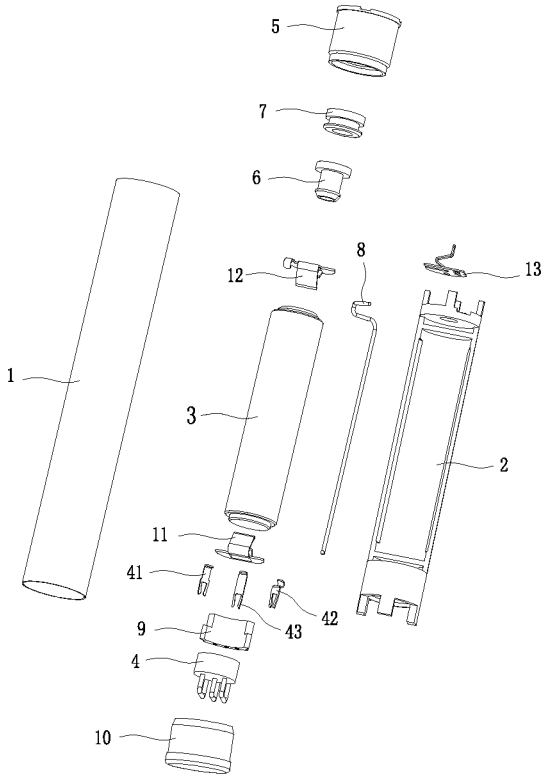
FIG. 1 is an exploded view of an electronic cigarette provided by a preferred embodiment of the present invention.

As shown in FIG. 1, an electronic cigarette is provided in an preferred embodiment of the present invention, and the electronic cigarette comprises an outer sleeve 1, a bracket 2, a battery 3, a controlling module 4, a first electrode connecting member 5, a second electrode connecting member 6, an insulating ring 7, a connecting wire 8, a mounting seat 9, a lamp assembly 10, a first elastic plate 11, a second elastic plate 12 and a third elastic plate 13. The outer sleeve 1 is approximately a hollow cylindrical structure, of which an inner surface is made of conductive material.

Figure 3:
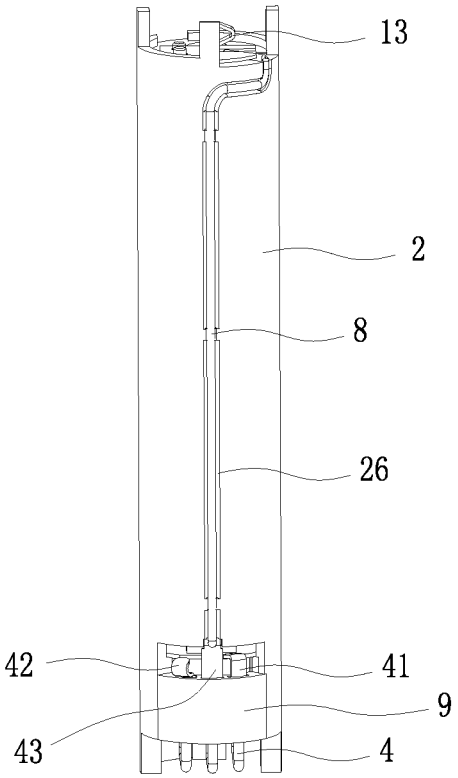
FIG. 3 is a structural schematic view of the electronic cigarette shown in FIG. 1 without an outer sleeve.
Figure 6:
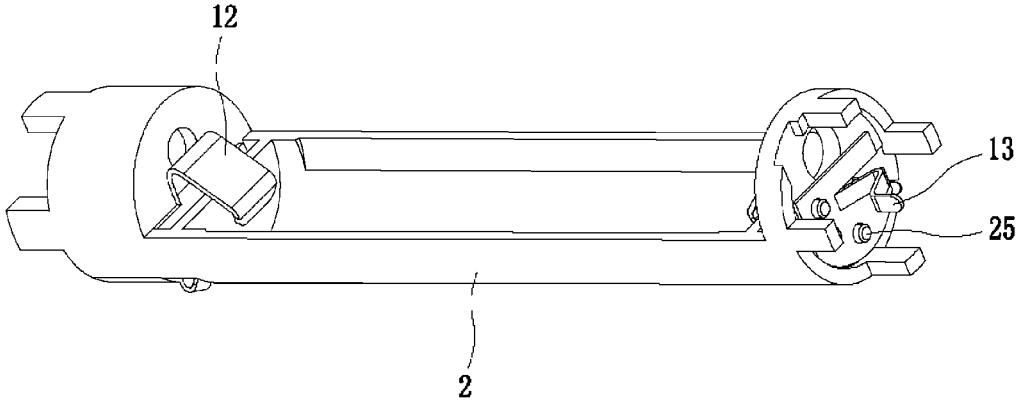
FIG. 6 is another perspective structural schematic view of the first elastic plate, the second elastic plate, the third elastic plate and the controlling module of the electronic cigarette shown in FIG. 5 which are all mounted on the bracket.
Figure 7:
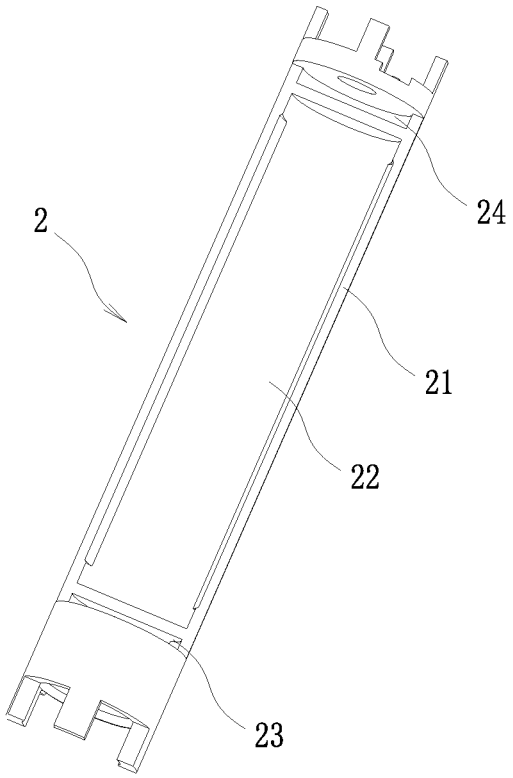
FIG. 7 is a perspective structural schematic view of the bracket of the electronic cigarette shown in FIG. 1.

As shown in FIG. 7, FIG. 3 and FIG. 6, the bracket 2 includes a bracket main body 21, a battery slot 22, a first elastic plate installed slot 23, a second elastic plate installed slot 24, a fastener 25 and an accommodating recess 26. The bracket main body 21 is approximately a cylindrical structure, the appearance and the size of which correspond to a hollow structure of the outer sleeve 1. The battery slot 22 is a structure having an opening, and roughly defined in the center position of the bracket main body 21; the battery 3 is detachably mounted inside the battery slot 22. The first elastic plate installed slot 23 is defined on the bracket main body 21, and located at the side of one end of the battery slot 22; the first elastic plate 11 is detachably mounted inside the first elastic plate installed slot 23. The second elastic plate installed slot 24 is defined on the bracket main body 21, and located at the side of the other end of the battery installed slot 22, that is, the second elastic plate installed slot 24 is disposed opposite the first elastic plate installed slot 23 across the battery slot 22, and the second elastic plate 12 is detachably mounted inside the second elastic plate installed slot 24. The fastener 25 is defined on an end of the bracket main body 21 and abuts the second elastic plate installed slot 24; the third elastic plate 13 is connected to the end of the bracket main body 21 by the fastener 25. In order to improve the soundness of connection between the third elastic plate 13 and the end of the bracket main body 21, more fasteners 25 can be provided. In the present embodiment, the number of fasteners 25 provided is three. The accommodating recess 26 is approximately disposed along the axial direction of the bracket main body 21, and defined on a side surface of the bracket main body 21; the connecting wire 8 is mounted inside the accommodating recess 26.

Figure 2:
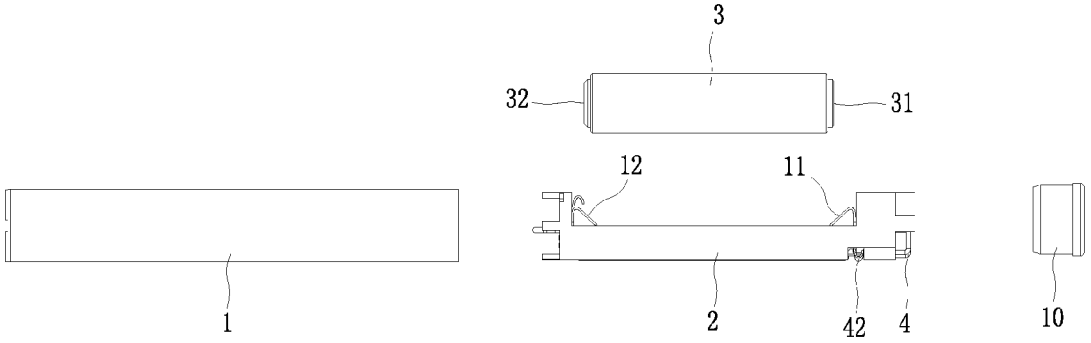
FIG. 2 is an assembly schematic view of the electronic cigarette shown in FIG. 1.

As shown in FIG. 2, the battery 3 includes a first electrode 31 and a second electrode 32. The first electrode 31 is disposed opposite the second electrode 32. The battery 3 can be a common dry cell. In the present embodiment, the first electrode 31 is positive electrode of the battery 3, and the second electrode 32 is negative electrode of the battery 3. In another embodiment of the present invention, the first electrode 31 also can be the negative electrode of the battery 3, and the second electrode 32 also can be the positive electrode of the battery 3.

Figure 11:
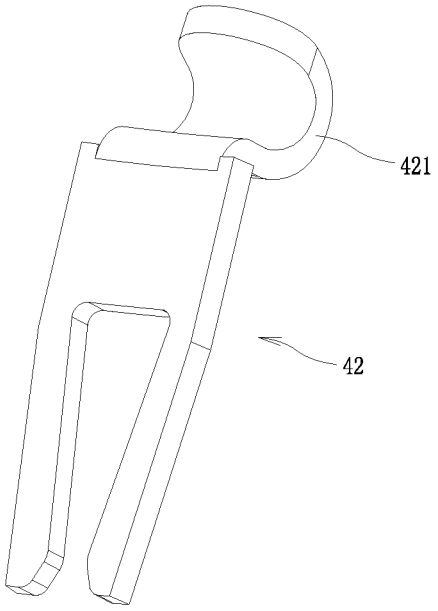
FIG. 11 is a perspective structural schematic view of a second electrode terminal of the electronic cigarette shown in FIG. 1.

As shown in FIG. 1, the controlling module 4 includes a first electrode terminal 41, a second electrode terminal 42 and a third electrode terminal 43. The controlling module 4 is detachably mounted on the bracket main body 21 and abuts the second elastic plate installed slot 24. In the present embodiment, the first electrode terminal 41 and the second electrode terminal 42 are input terminals of the controlling module 4, that is, the battery 3 can supply the electric power to the controlling module 4 via the first electrode terminal 41 and the second electrode terminal 42; the third electrode terminal 43 is an output terminal of controlling signals of the controlling module 4. Herein, the first electrode terminal 41 and the first electrode 31 are electrically connected to each other; the second electrode terminal 42, the second electrode 32 and the first electrode connecting member 5 are all electrically connected to each other; the third electrode terminal 43 and the second electrode connecting member 6 are electrically connected to each other. As shown in FIG. 11, an end of the second electrode terminal 42 that abuts the battery 3, defined a convex terminal resisting part 421; the terminal resisting part 421 and an inner surface of the outer sleeve 1 abut against each other.

Figure 4:
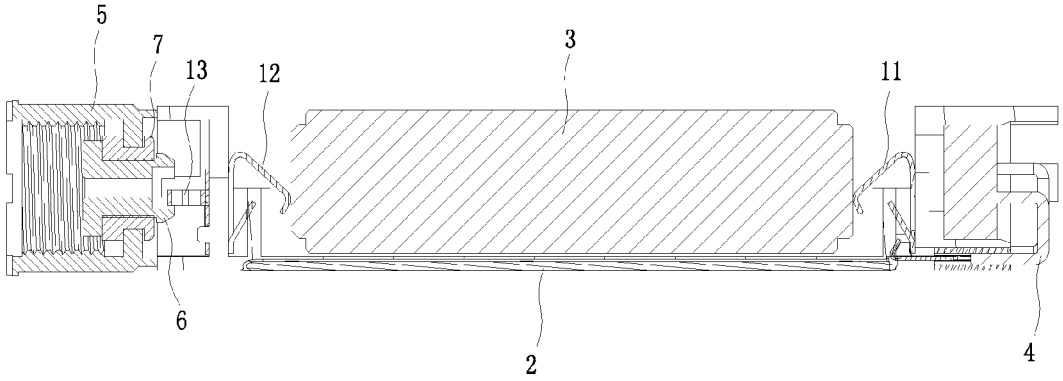
FIG. 4 is a cut-away schematic view of the electronic cigarette shown in FIG. 3.
Figure 5:
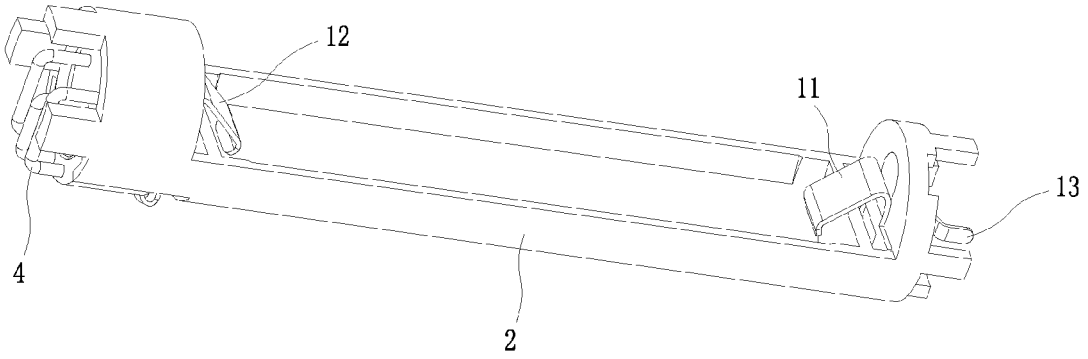
FIG. 5 is a perspective structural schematic view of a first elastic plate, a second elastic plate, a third elastic plate and a controlling module of the electronic cigarette shown in FIG. 1 which are all mounted on a bracket.

As shown in FIG. 1 and FIG. 4, the first electrode connecting member 5, the second electrode connecting member 6 and the insulating ring 7 are mounted on the end of the outer sleeve 1. The first electrode connecting member 5 and an inner surface of the outer sleeve 1 abut against each other. The first electrode connecting member 5 and the second electrode connecting member 6 that are respectively connected to the two electrodes (not shown) of an atomizer assembly (not shown), are configured to supply the electric power to the atomizer assembly for needs of working. The insulating ring 7 is mounted between the first electrode connecting member 5 and the second electrode connecting member 6, and configured to achieve electrical insulation.

As shown in FIG. 3, one end of the connecting wire 8 is electrically connected to the third electrode terminal 43, and the other end of the connecting wire 8 is electrically connected to the third elastic plate 13. By adopting a structure of the connecting wire 8, electrical connection between the third electrode terminal 43 and the third elastic plate 13 can be achieved. A structure of the connecting wire 8 can be designed according to the spatial relationship between the third electrode terminal 43 and the third elastic plate 13, so that electrical connection between the third electrode terminal 43 and the third elastic plate 13 can be achieved firmly.

As shown in FIG. 1, the mounting seat 9 is mounted on the bracket main body 21. The first electrode terminal 41, the second electrode terminal 42 and the third electrode terminal 43 are respectively mounted on the mounting seat 9. By adopting a structure of the mounting seat 9, the first electrode terminal 41, the second electrode terminal 42 and the third electrode terminal 43 are electrically insulated with each other.

As shown in FIG. 1, the lamp assembly 10 is mounted on an end of the outer sleeve 1 that is aloof from the first electrode connecting member 5. The lamp assembly 10 is electrically connected to the controlling module 4. When the electronic cigarette is working, the lamp assembly 10 is driven by the controlling module 4 to work to indicate that the electronic cigarette is working. A shell (not shown) of the lamp assembly 10 is made of soft rubber material, easily mounted on the outer sleeve 1, and has good sealing performance.

Figure 8:
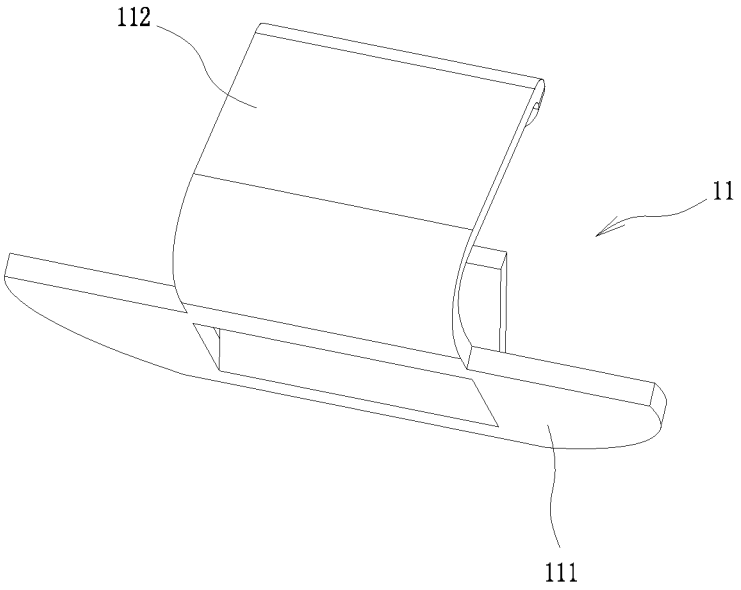
FIG. 8 is a perspective structural schematic view of the first elastic plate of the electronic cigarette shown in FIG. 1.

As shown in FIG. 8, the first elastic plate 11 includes a first fixed part 111, and a first elastic part 112. The first fixed part 111 is approximately a sheet structure, and mounted inside the first elastic plate installed slot 23; the first fixed part 111 and the first electrode terminal 41 abut against each other. The first elastic part 112 is defined on the first fixed part 111, it is convex and has good elasticity; the first elastic part 112 is defined inside the battery installed slot 22, and elastically abuts against the first electrode 31. In the present embodiment, by adopting a structure of the first elastic plate 11, the electrical connection between the first electrode terminal 41 and the first electrode 31 can be achieved, so that the battery 3 can elastically abut against the battery slot 22 firmly.

Figure 9:
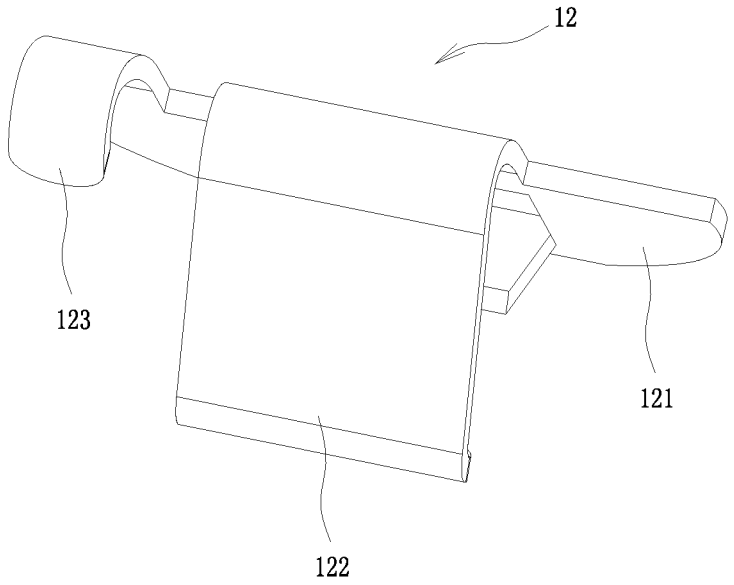
FIG. 9 is a perspective structural schematic view of the second elastic plate of the electronic cigarette shown in FIG. 1.

As shown in FIG. 9, the second elastic plate 12 includes a second fixed part 121, a second elastic part 122 and an elastic resisting part 123. The second fixed part 121 is approximately a sheet structure, and mounted inside the second elastic plate installed slot 24; the second elastic part 122 and the elastic resisting part 123 are both defined on the first fixed part 111 respectively and convex. In this embodiment, the second elastic part 122 and the elastic resisting part 123 protrude on the same side and have good elasticity. The second elastic part 122 is defined inside the battery slot 22, and elastically abuts against the second electrode 32. The elastic plate resisting part 123 and the inner surface of the outer sleeve 1 abut against each other. The inner surface of the outer sleeve is made of conductive material, and both the terminal resisting part 421 and the first electrode connecting member 5 abut against the inner surface of the outer sleeve 1. In this embodiment, by adopting a structure of the second elastic plate 12, electrical connection between the second electrode terminal 42 and the second electrode 32 can be achieved, so that the battery 3 can elastically abut against the battery slot 22 firmly.

Figure 10:
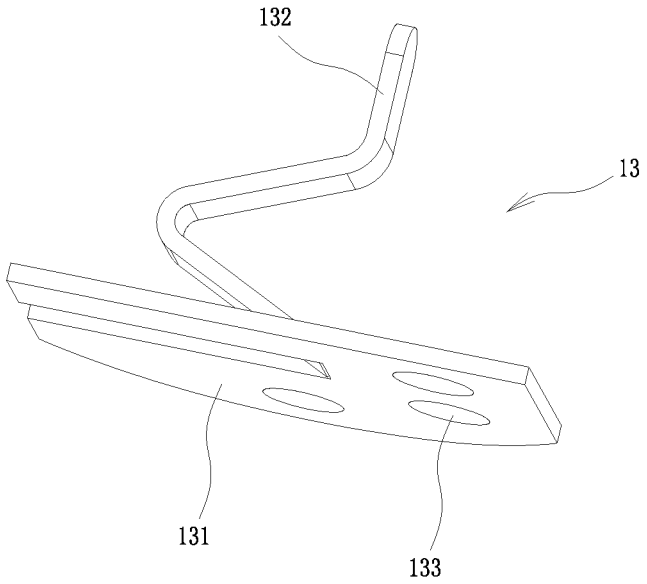
FIG. 10 is a perspective structural schematic view of the third elastic plate of the electronic cigarette shown in FIG. 1.

As shown in FIG. 10, the third elastic plate 13 includes a third fixed part 131, a third elastic part 132 and a fastening recess 133. The third fixed part 131 is approximately a sheet structure; the third elastic part 132 is defined on the third fixed part 131 and convex, and has good elasticity; the third elastic part 132 and the second electrode connecting member 6 elastically abut against each other. The fasteners 25, of which the number is equal to the number of the fastening recesses 133, are defined the third fixed part 131. Any one of the fastening recesses 133 fastens one of the fasteners 25, so that the third elastic plate 13 can be firmly mounted on the bracket main body 21. In another embodiment of the present invention, the third fixed part 131 defines a structure of a fastener, and an end of the bracket main body 21 defines a structure of a fastening recess. Electrical connection between the third electrical terminal 43 and the third elastic plate 13 is achieved by the connecting wire 8. In the present embodiment, by a structure of the third elastic plate, electrical connection between the third electrical terminal 43 and the second electrode connecting member 6 can be achieved. At the same time, the third elastic plate 13 is mounted on a portion of an end of the bracket main body 21, so that the bracket main body 21 can be mounted inside the outer sleeve 1 firmly, and can not easily come loose.

As shown in FIG. 2 to FIG. 6, the process of assembly is as follows: at first, the first electrode connecting member 5, the second electrode connecting member 6 and the insulating ring 7 are respectively mounted on the end of the outer sleeve 1; then the controlling module 4, the mounting seat 9, the first elastic plate 11, the second elastic plate 12 and the third elastic plate 13 are respectively mounted on the corresponding portions of the bracket 2; after that, the battery 3 is mounted inside the battery slot 22, and elastically abutted against between the first elastic plate 11 and the second elastic plate 12; at last, the bracket 2 is pushed into the outer sleeve 1, and the lamp assembly 10 is buckled to the end of the outer sleeve 1.

Another preferred embodiment of the present invention provides an electronic cigarette, and the difference of this embodiment and the above-described embodiment is the structure of the outer sleeve 1. In this embodiment, the outer sleeve 1 includes an atomizing sleeve (not shown) and the battery sleeve detachably connected to the atomizing sleeve (not shown); an atomizer assembly is mounted inside the atomizing sleeve; the bracket 2, the battery 3, the controlling module 4, the first electrode connecting member 5 and the second electrode connecting member 6 are all mounted inside the battery sleeve. In this embodiment, the first electrode connecting member 5 adopts a structure of an internal threaded part, and detachably mounted on the atomizer assembly. In another embodiment, the first electrode connecting member 5 can also adopt a structure of an external threaded part. By adopting a structure of the bracket 2 in the electronic cigarette, the battery 3 and the controlling module 4 can be detachably mounted in the outer sleeve 1 so that the replacement of the battery and automated production can be easily achieved; then, structures that the first elastic plate 11 elastically abuts against the first electrode 31, and the second elastic plate 12 elastically abuts against the second electrode 32, are adopted by the electronic cigarette, so that the battery 3 can be mounted on the bracket 2 more firmly, and the operation of unloading the battery 3 can be achieved easily; furthermore, by adopting a structure of the third elastic plate 13 by the electronic cigarette, the bracket 2 can be mounted inside the outer sleeve 1 firmly, and can be not easily come loose.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette comprising:

an outer sleeve;

a battery mounted inside the outer sleeve, the battery includes a first electrode and a second electrode, and the first electrode is disposed opposite to the second electrode;

a controlling module configured to control working of the electronic cigarette, the controlling module includes a first electrode terminal which is electrically connected to the first electrode, a second electrode terminal which is electrically connected to both the second electrode and the first electrode connecting member, and a third electrode terminal which is electrically connected to the second electrode connecting member;

a bracket detachably mounted inside the outer sleeve; both the battery and the controlling module are mounted on the bracket;

a first electrode connecting member and a second electrode connecting member; both the first electrode connecting member and the second electrode connecting member are mounted on an end of the outer sleeve; wherein an inner surface of the outer sleeve is made of conductive material;

wherein the electronic cigarette further comprises a first elastic plate which is connected to the first electrode and the first electrode terminal, a second elastic plate which is connected to the second electrode and the second electrode terminal, and a third elastic plate which is connected to the second electrode connecting member and the third electrode terminal;

wherein the second elastic plate includes a second fixed part, a second elastic part in a convex shape and an elastic plate resisting part; the second elastic part and the elastic plate resisting part are both mounted on the second fixed part; an end of the second electrode terminal, abutting the battery, defines a terminal resisting part which is in a convex shape;

wherein the second elastic part elastically abuts against the second electrode; the elastic plate resisting part, the terminal resisting part and the first electrode connecting member all abut against an inner surface of the outer sleeve.

2. The electronic cigarette according to claim 1, wherein the electronic cigarette further comprises a mounting seat; the first electrode terminal, the second electrode terminal and the third electrode terminal are respectively mounted on the mounting seat.

3. The electronic cigarette according to claim 1, wherein the bracket includes a bracket main body and a battery slot defined on the bracket main body and corresponding to the battery; the battery is detachably mounted inside the battery slot.

4. The electronic cigarette according to claim 3, wherein the first elastic plate includes a first fixed part, and a first elastic part which is in a convex shape and is defined on the first fixed part;

the first fixed part is mounted on the bracket main body, and abuts against the first electrode terminal; and the first elastic part is disposed inside the battery slot and elastically abuts against the first electrode.

5. The electronic cigarette according to claim 4, wherein the bracket further includes a first elastic plate installed slot defined on the bracket main body and abutting an end of the first electrode; the first fixed part is mounted inside the first elastic plate installed slot.

6. The electronic cigarette according to claim 3, wherein the bracket further includes a second elastic plate installed slot defined on the bracket main body and abutting the second electrode; the second fixed part is mounted inside the second elastic plate installed slot.

7. The electronic cigarette according to claim 3, wherein the third elastic plate includes a third fixed part electrically connected to the third electrode terminal and a third elastic part which is in a convex shape and is defined on the third fixed part;

an end of the bracket main body, abutting the second electrode and the third fixed part are connected to each other; the third elastic part elastically abuts against the second electrode connecting member.

8. The electronic cigarette according to claim 7, wherein the electronic cigarette further comprises a connecting wire; one end of the connecting wire is electrically connected to the third electrode terminal, and the other end of the connecting wire is electrically connected to the third fixed part.

9. The electronic cigarette according to claim 6, wherein the bracket also includes a fastener defined on an end of the bracket main body and abutting the second elastic plate installed slot; the third fixed part defines a fastening recess fastened and connected to the fastener.

10. The electronic cigarette according to claim 6, wherein the bracket further includes a fastening recess defined on an end of the bracket main body and abutting the second elastic plate installed slot; the third fixed part defines a fastener fastened and connected to the fastening recess.

11. The electronic cigarette according to claim 1, wherein the electronic cigarette further comprises an insulating ring defined between the first electrode connecting member and the second electrode connecting member and configured to achieve electrical insulation.

12. The electronic cigarette according to claim 1, wherein the electronic cigarette further comprises a lamp assembly;

the lamp assembly is mounted on an end of the outer sleeve that is away from the first electrode connecting member.

13. The electronic cigarette according to claim 12, wherein a shell of the lamp assembly is made of soft rubber material.

14. The electronic cigarette according to claim 1, wherein the outer sleeve includes an atomizing sleeve and a battery sleeve detachably connected to the atomizing sleeve; an atomizer assembly of the electronic cigarette is mounted inside the atomizing sleeve; the bracket, the battery, the controlling module are all mounted inside the battery sleeve.

15. The electronic cigarette according to claim 1, wherein, both the battery and the controlling module are detachably mounted on the bracket.

* * * * *